US007105759B1

(12) United States Patent
Mucha

(10) Patent No.: US 7,105,759 B1
(45) Date of Patent: Sep. 12, 2006

(54) INSTRUMENT WITH ILLUMINATED CONTROL KNOB

(75) Inventor: Jeff Mucha, Portland, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 11/170,284

(22) Filed: Jun. 28, 2005

(51) Int. Cl.
*H01H 9/18* (2006.01)

(52) U.S. Cl. ..... 200/310; 200/316; 200/336

(58) Field of Classification Search ..... 200/310–316, 200/336, 564, 19.18
See application file for complete search history.

(56) References Cited

U.S. PATENT DOCUMENTS 4,488,020 A * 12/1984 Zalewski et al. ..... 200/436
4,501,937 A * 2/1985 Anderson et al. ..... 200/5 A
5,120,920 A * 6/1992 Moriike ..... 200/341
6,420,667 B1 * 7/2002 Miwa et al. ..... 200/4
6,474,833 B1 * 11/2002 Parsons et al. ..... 362/205
6,737,596 B1 * 5/2004 Hein ..... 200/310
6,967,056 B1 * 11/2005 Kashino ..... 428/189
7,011,422 B1 * 3/2006 Robertson et al. ..... 362/95
7,014,330 B1 * 3/2006 Yokoyama et al. ..... 362/23
2002/0003081 A1 * 1/2002 Kawase ..... 200/4
2005/0150751 A1 * 7/2005 Matsuyama et al. ..... 200/310
2005/0284741 A1 * 12/2005 Suzuki ..... 200/310
2006/0016676 A1 * 1/2006 Jung ..... 200/314

* cited by examiner

*Primary Examiner*—Michael A. Friedhoffer
*Assistant Examiner*—Lisa Klaus
(74) *Attorney, Agent, or Firm*—Bennet K. Langlotz; Thomas F. Lenihan

(57) ABSTRACT

An electronic instrument has a rotary switch with an extending shaft, a light source proximate to the shaft, and a knob attached to the shaft. The knob has a body with a rear face, an opposed front face, and side surfaces extending between the faces. The rear face defines a bore sized to receive a free end of the shaft. The body has a light-transmissive portion extending from a first surface portion of the rear face surrounding the bore, such that light from the light source enters the light transmissive portion regardless of the rotary position of the knob. The light-transmissive portion of the body extends to a window in the side surface or the front face.

19 Claims, 3 Drawing Sheets

FIG.1
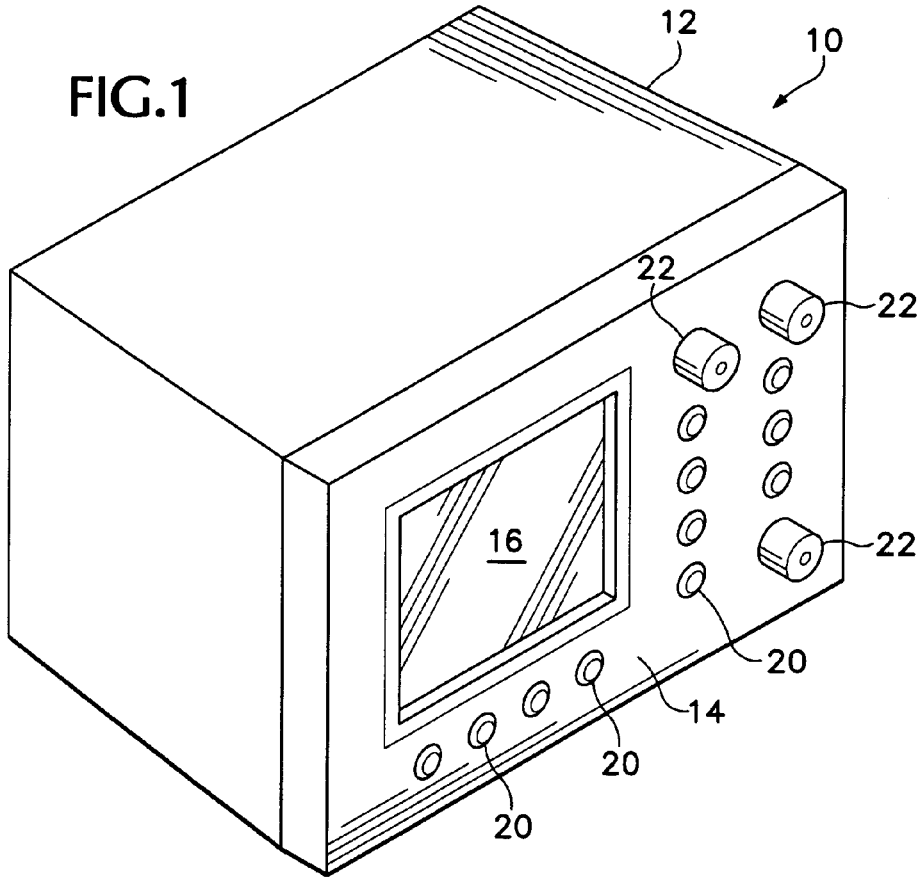
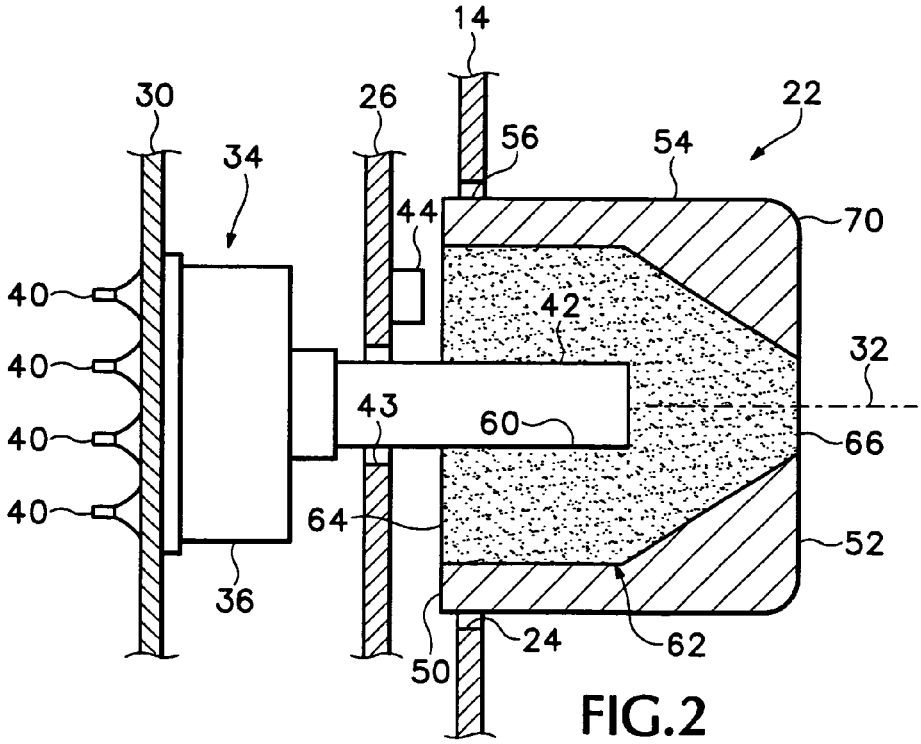
FIG.2

INSTRUMENT WITH ILLUMINATED CONTROL KNOB

FIELD OF THE INVENTION

The subject invention generally relates to the field of control switches and knobs for electronic instruments.

BACKGROUND OF THE INVENTION

Electronic instruments such as Digital Oscilloscopes and other test and measurement equipment typically have an array of control knobs and buttons for selecting functions and adjusting parameters. Some such instruments have multi-function knobs that perform different functions in different circumstances. This permits the use of larger screen sizes on instruments of a given size, with smaller control panels.

When a knob is to perform multiple functions, it is useful to provide some kind of indication to the user about the current function. This has typically been achieved with adjacent illuminated annunciator labels, such as with light sources behind light-transmissive icons or text in a film on the instrument's front panel. However, with the increasing number of functions, the front panel may appear cluttered, may have inadequate space, or there may be confusion as to which label applies to which knob.

Illuminated knobs have been used in some applications, primarily for identifying the location or setting of a knob in a dark environment such as an automotive or aircraft instrument panel. Such knobs are employed with special switches to allow illumination through passages or light pipes. However, for sophisticated applications requiring controls meeting demanding electronic specifications, such illumination is impractical because such controls are not designed to transmit the needed light. Illumination techniques for such controls would generally lead to an unattractive or non-uniform result.

While a custom rotary switch having certain optical properties or configuration may be designed, this is often impractical for many applications where only small quantities are required (unlike the automotive industry) and where there is cost sensitivity (unlike the aerospace industry.) Thus, there is a need for a system that operates in conjunction with off-the-shelf switches.

The preferred embodiment addresses these needs in the following:

SUMMARY OF THE INVENTION

An electronic instrument has a rotary switch with an extending shaft, a light source proximate to the shaft, and a knob attached to the shaft. The knob has a body with a rear face, an opposed front face, and side surfaces extending between the faces. The rear face defines a bore sized to receive a free end of the shaft. The body has a light-transmissive portion extending from a first surface portion of the rear face surrounding the bore, such that light from the light source enters the light transmissive portion regardless of the rotary position of the knob. The light-transmissive portion of the body extends to a window in the side surface or the front face.

BRIEF DESCRIPTION OF THE DRAWINGS

FIG. 1 shows an instrument according to a preferred embodiment of the invention.

FIG. 2 is a sectional side view of a switch and knob according to the embodiment of FIG. 1.

DETAILED DESCRIPTION OF A PREFERRED EMBODIMENT

Figure 3:
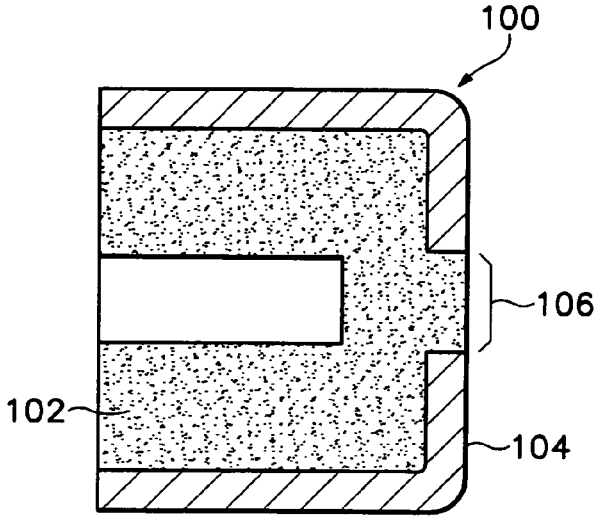
FIG. 3 is a knob according to an alternative embodiment of the invention.

FIG. 1 shows an electronic instrument 10 with a housing 12 containing circuitry (not shown). The housing has a front panel 14 on which are provided a display screen 16, and an array of buttons 20 and rotary knobs 22.

As shown in FIG. 2, the front panel 14 defines a circular aperture 24 that closely receives the knob 22. A first circuit board 26 resides parallel to and behind the panel 14 in the housing, and a second board 30 resides behind the first board. A knob axis 32 defines a rotational axis of the knob, and the center of the aperture 24. A rotary switch 34 is mounted to the second board 30, with a body 36 against a forward facing surface of the second board, and contacts 40 electrically connected to the board and to other instrument circuitry. The body is a flat circular disc, with a rotating shaft 42 protruding in a forward direction along the axis 32. As is typical for conventional rotary switches, the switch body and shaft are opaque. One example of such a rotary switch is model REB 162PVBS from Noble USA Inc. of Rolling Meadows, Ill.

The first circuit board 26 defines an aperture 43 centered on the axis 32 and sized to closely receive the shaft 42. A multi-color LED light source 44 is mounted to a forward face of the first board 26, adjacent to the aperture 43, and electrically connected to instrument circuitry. The LED is capable of illumination at a range of colors and brightness. The first and second board are closely spaced apart, providing adequate room for the switch body. The first board is spaced closely with respect to the rear surface of the front panel 14.

The knob is a cylindrical or disc-shaped form that has a rear surface 50 facing to the rear and perpendicular to the axis 32, toward the interior of the housing, a parallel front surface 52 positioned at a level well forward of the front panel, and a cylindrical side wall 54 that mostly protrudes beyond the panel face, with a limited rear portion 56 closely received within the panel aperture 24.

The knob defines a shaft bore 60 centered on the rear face 50, and extending a limited depth into the body of the knob along the axis 32, short of the front surface 52. The bore is entirely defined by a light transmissive central knob portion 62 that has a rear face 64 that has an annular shape, and which entirely surrounds the shaft. The Bore has a notch in it that matches the notch in the shaft so the shaft doesn't free spin, and may include internal ribs (not shown) on the inside of a larger bore, so that the ribs fit snug against the shaft with increased tolerance of dimensional variations.

The rear face has a diameter large enough so that a portion of the rear face is positioned above the LED at all rotational positions of the knob. The central portion extends to an exposed surface of the knob, to transmit light from the LED to a surface where it can be seen. In the illustrated embodiment, the central portion extends to a central window 66 centered in the front surface. The central window is the only portion of the central knob portion that is visible to a user. The central portion is preferably formed of a rigid plastic material that includes a diffusant in a transparent material, to provide a uniform, soft illumination that is viewable from any angle with an essentially lambertian light output profile.

An opaque outer portion 70 provides the remainder of the exterior of the knob, filling the volume of the desired knob form. The outer portion may be an overmolded plastic or elastomer. Essentially, the central portion acts as a light pipe having an inlet positioned over the light source in all pertinent positions, and having an outlet at the exterior surface of the knob.

In operation, the LED may be illuminated for a wide range of purposes, including indicating the knob function, such as by illuminating with a color associated with the color of a cursor or other element on the color display screen, to indicate that the illuminated knob controls the cursor of the same color. This provides advantages for complex displays, and instruments having multiple knobs. The LED may flash or fade-in/fade-out to further highlight the knob, or to associate it with a displayed element flashing synchronously on the display screen. By the use of multi-color light sources, which may alternatively be provided by an array of different color lights surrounding the aperture 43, and with multiple knobs on an instrument, each knob may be assigned to different uses, and the user may determine the use based on the color, instead of by memorizing the knob location.

In alternative embodiments, the two circuit boards may be replaced by a single board, when used in conjunction with a rotary switch having a shaft extending from the mounting surface of the switch body, so that the body of the knob would be connected to the rear of the board, with the shaft extending through an aperture from the front surface of the board. In this version, the LED may be mounted to the front surface of the same board, adjacent to the aperture. In further alternatives, the front panel may have a small aperture that closely surrounds the shaft, and the entire knob is positioned forward of the front surface of the front panel.

FIG. 3 shows an alternative knob 100, with a central portion 102 providing nearly all the volume of the knob, and a thin opaque shell 104 surrounding the exposed surfaces of the knob, except at the window 106. This configuration is preferred when the outer material is an elastomer or for other material that benefits from a uniform wall thickness due to shrinkage after molding.

Figure 4A:
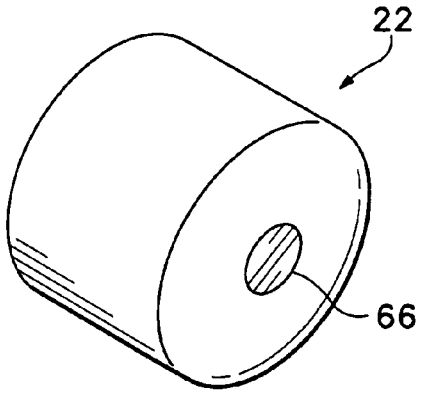
FIGS. 4A–4C illustrate knobs according to alternative embodiments of the invention.
Figure 4B:
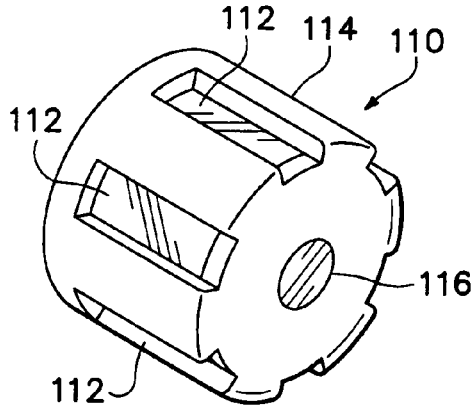
Figure 4C:
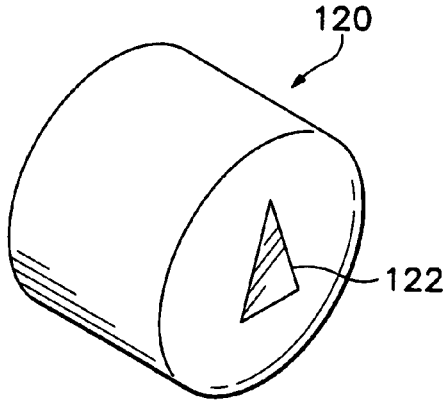

FIG. 4A shows the knob 22 of the preferred embodiment, with the window 66 as a simple circle. FIG. 4B illustrates an alternative window configuration on a knob 110 having windows 112 formed in the outer shell 114 of the sidewall, away from a central window 116. FIG. 4C illustrated a knob 120 with an alternative window 122 in the form of a pointer, to indicate the rotational position of the knob to a user. The knob's window or windows may be in any shape or pattern, including text or other images.

Figure 5:
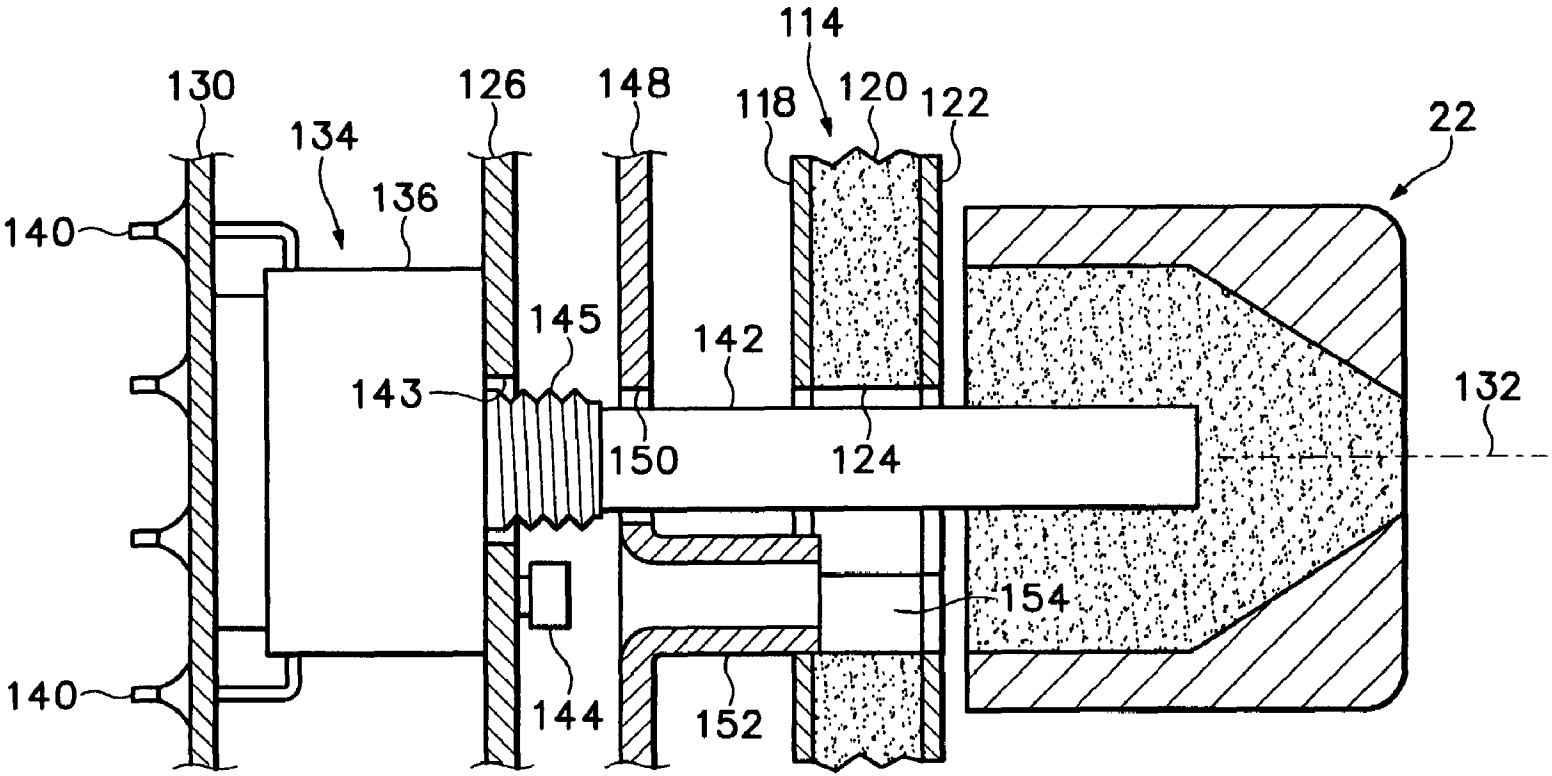
FIG. 5 is a sectional side view of a switch and knob according to an alternative embodiment of FIG. 1.

FIG. 5 shows an alternative configuration in which a front panel 114 is formed of a sandwich of a metal shield 118, a rigid central foam core 120, and a front film 122 on which transparent indicia are printed. The front panel defines a aperture 124 that closely receives the shaft 142 of the switch. A first circuit board 126 resides parallel to and behind the panel 114 in the housing, and a second board 130 resides behind the first board. A knob axis 132 defines a rotational axis of the knob, and the center of the aperture 124. The rotary switch 134 is mounted to the second board 130, with a body 136 against a forward facing surface of the second board, and contacts 140 electrically connected to the first board and to other instrument circuitry. The body is a flat body, with the rotating shaft 142 protruding in a forward direction along the axis 132.

The first circuit board 126 defines an aperture 143 centered on the axis 132 and sized to closely receive a threaded sleeve 145 surrounding the shaft 142. (In the single board embodiment discussed above, a nut may engage the sleeve to capture the board at the front of the switch body.) The first circuit board 126 is positioned at the front of the switch body. A multi-color LED light source 144 is mounted to a forward face of the first circuit board 126, adjacent to the aperture 143, and electrically connected to instrument circuitry.

A elastomeric sheet 148 is received between the first board and the front panel, and in areas outside of the illustrated portion, includes formed buttons that protrude from apertures in the front panel; each button has associated contacts for making electrical connections with conductive pads on the front of the first board. The sheet 148 has an aperture 150 for passage of the shaft 142. Adjacent to the aperture 150, in registration with the LED 144, the sheet includes a cylindrical pipe portion 152 that contains and directs rays from the LED toward the knob. The pipe is a cylinder oriented perpendicularly to the plane of the sheet, and extends to the front panel. The aperture 124 is primarily a circle centered on the shaft, but also includes a lobe 154 that is the form of a small circle centered on the axis defined by the pipe and LED. The central transparent portion of the knob is sized large enough to fully overlay the lobe 154 to capture essentially all the light passing from the front of the front panel.

This disclosure is made in terms of preferred and alternative embodiments, and is not intended to be so limited.

The invention claimed is:

1. A knob for an electronic instrument having a rotary switch with an extending shaft, and a light source proximate to the shaft, the knob comprising:

a body having a rear face, an opposed front face, and side surfaces extending between the faces;

the rear face defining a bore sized to receive a free end of the shaft;

the body having a light-transmissive portion extending from a first surface portion of the rear face surrounding the bore, such that light from the light source enters the light transmissive portion regardless of the rotary position of the knob; and the light-transmissive portion of the body extending to at least a first window portion of at least one of the side surfaces and the front face.

2. The knob of claim 1 wherein the body includes an opaque portion covering at least a second portion of at least one of the side surfaces and the front face other than the first window portion of the front face.

3. The knob of claim 2 wherein the first window portion is a central aperture in the opaque portion.

4. The knob of claim 2 wherein the light transparent portion comprises the majority of the volume of the body, and the opaque portion is a coating of substantially uniform thickness.

5. The knob of claim 2 wherein the opaque portion is an elastomer.

6. The knob of claim 1 wherein the first surface portion of the rear face is annular.

7. The knob of claim 1 wherein the light source is a multi-color LED.

8. The knob of claim 1 wherein the first window portion has a visible exposed portion in a selected pattern.

9. The knob of claim 8 wherein the pattern is a central dot.

10. The knob of claim 8 wherein the pattern is a pointer.

11. An electronic instrument comprising:

a housing containing circuitry and having an exterior interface panel;

a switch element connected to the circuitry and within the housing;

the switch including a switch body and an elongated element extending from the body in a forward direction, and movable with respect to the body to a plurality of plurality of positions to change the switch between a plurality of electrical states;

a light source connected to the circuitry and positioned in the forward direction from at least a portion of the switch body;

a knob connected to the extension and having a transparent portion including a transparent inlet portion adjacent to the light source; and the transparent portion of the knob having an outlet portion away from the light source, and external of the interface panel.

12. The instrument of claim 11 wherein the elongated element is an opaque material.

13. The instrument of claim 11 wherein the circuitry includes two circuit boards, with the switch electrically connected to a first board, and the light source connected to a second board.

14. The instrument of claim 13 wherein the second board defines an aperture through which the elongated element extends.

15. The instrument of claim 11 wherein knob includes an opaque portion covering at least a portion of the transparent portion.

16. The instrument of claim 15 wherein the outlet portion is a central aperture in the opaque portion.

17. The instrument of claim 15 wherein the opaque portion is an elastomer.

18. The instrument of claim 11 wherein the at least a rear surface portion of the transparent portion surrounds the elongated element.

19. The instrument of claim 11 wherein the light source is a multi-color LED.

* * * * *